United States Patent [19]

Ward et al.

[11] 4,376,746

[45] Mar. 15, 1983

[54] FORMATION OF HOLLOW TAPERED BRUSH BRISTLES

[75] Inventors: John Ward, Crofton; Robert Austin, Crownsville; Anthony Genovese, Baltimore, all of Md.

[73] Assignee: Ametek, Inc., Odenton, Md.

[21] Appl. No.: 303,324

[22] Filed: Sep. 17, 1981

Related U.S. Application Data

[62] Division of Ser. No. 136,580, Apr. 1, 1980, Pat. No. 4,307,478.

[51] Int. Cl.[3] ..... D01D 5/20

[52] U.S. Cl. ..... 264/167; 264/177 F; 264/288.8; 264/541; 425/382.2; 425/463; 425/467; 264/209.5

[58] Field of Search ..... 264/533, 541, 177 F, 264/178 G, 209.1, 209.5, 561, 167, 288.8; 425/382.2, 463, 467

[56] References Cited

U.S. PATENT DOCUMENTS

| | | | |
|---|---|---|---|
| 1,707,164 | 3/1929 | Karplus | 264/49 |
| 2,433,325 | 12/1947 | Slaughter | 264/177 F |
| 2,666,976 | 1/1954 | Olmer et al. | 428/399 |
| 2,746,839 | 5/1956 | Terry et al. | 264/177 F |
| 2,940,126 | 6/1960 | Sheridan | 264/557 |
| 3,121,040 | 2/1964 | Shaw et al. | 264/177 F |
| 3,152,202 | 10/1964 | Murphy | 264/288.8 |
| 3,184,822 | 5/1965 | Shaw | 264/177 F |
| 3,323,168 | 6/1967 | Van Drunen et al. | 425/461 |
| 3,330,899 | 7/1967 | Fukushima et al. | 264/210.6 |
| 3,340,571 | 9/1967 | Bishop et al. | 425/464 |
| 3,373,223 | 3/1968 | Armstrong | 525/179 |
| 3,402,416 | 9/1968 | Shaw et al. | 428/399 |
| 3,465,618 | 9/1969 | McIntosh et al. | 425/72 R |
| 3,493,459 | 2/1970 | McIntosh et al. | 428/398 |
| 3,558,420 | 1/1971 | Opfell | 428/398 |
| 3,600,491 | 8/1971 | Shimoda et al. | 264/177 F |
| 3,605,162 | 9/1971 | Long | 428/398 |
| 3,630,824 | 12/1971 | Rohlig | 264/177 F |
| 3,684,647 | 8/1972 | Matsui et al. | 428/373 |
| 3,728,428 | 4/1973 | Turner | 264/177 F |
| 3,745,061 | 7/1973 | Champaneria et al. | 428/398 |
| 3,763,299 | 10/1973 | So | 264/207 |
| 3,772,137 | 11/1973 | Tolliver | 428/369 |
| 3,781,391 | 12/1973 | Shimoda et al. | 264/53 |
| 3,924,988 | 12/1975 | Hodge | 425/461 |
| 3,981,948 | 9/1976 | Phillips | 264/40.7 |
| 4,020,229 | 4/1977 | Cox, Jr. | 428/372 |
| 4,055,696 | 10/1977 | Kamada et al. | 428/398 |
| 4,245,383 | 1/1981 | Boggs | 264/288.8 |

FOREIGN PATENT DOCUMENTS

| | | | |
|---|---|---|---|
| 695270 | 9/1964 | Canada | 264/177 F |
| 47-17089 | 5/1972 | Japan | 264/177 F |
| 47-25809 | 7/1972 | Japan | 264/177 F |
| 54-15023 | 2/1979 | Japan | 264/177 F |

*Primary Examiner*—Jay H. Woo

*Attorney, Agent, or Firm*—Karl W. Flocks; Sheridan Neimark

[57] ABSTRACT

Improved paint brush bristles formed of synthetic materials are hollow and tapered with a central axial hollow. The tapered hollow bristles are characterized by their consistent wall thickness, i.e., ratio of cross-sectional hollow area to cross-sectional wall area remains consistent from one end of the bristle to the other; and by their consistency in neck-down location.

9 Claims, 5 Drawing Figures

FORMATION OF HOLLOW TAPERED BRUSH BRISTLES

This is a division of application Ser. No. 136,580, filed Apr. 1, 1980 now U.S. Pat. No. 4,307,478.

FIELD OF THE INVENTION

The present invention relates to paint brushes and to synthetic hollow tapered filaments used therein, and more particularly to synthetic hollow tapered paint brush bristles and their formation.

BACKGROUND

Paint brush bristles made of synthetic materials have been known for many years. It has long been known that the best synthetic paint brush bristles are those which are tapered, and the Olmer U.S. Pat. No. 2,666,976 is an early patent showing the manufacture of synthetic tapered brush bristles, in this case formed from a solution of acrylonitrile polymer. This patent also mentions that it is desirable for the bristles to have internal void spaces or to be hollow. However, for a variety of reasons which will be pointed out below, it has not heretofore been possible to make satisfactory tapered hollow brush bristles from synthetic resins.

The paint brush manufacturing industry now uses a wide variety of synthetic bristles, in addition to natural bristles. These are made of various materials including, most importantly, polyester and nylon. Until recently, the synthetic filaments were of the solid (not hollow) type, and these were provided in both the level (untapered) and tapered shapes. More recently, commercial level hollow bristles have come into the marketplace, but still the filament manufacturing industry has not been able to provide the paint brush industry with the desired tapered, hollow bristles. Very recently, one manufacturer has managed to bring into the market a tapered bristle having the cross-section shown in FIG. 2 of the Champaneria U.S. Pat. No. 3,745,061, but this is still not the configuration most desired by the paint brush industry.

Tapered filaments are desired for paint brush bristles in order to give desired properties to the completed paint brush; important among these properties is the "snap-back" of the brush (i.e., this is a certain kind of stiffness in the brush which ensures that after the brush is deformed from its normal straightness, it snaps back to its usual position). The paint brush industry also demands a different type of stiffness in their brush bristles, namely a relatively high stiffness-to-weight ratio. The reason that hollow filaments are in demand is because they have a higher stiffness-to-weight ratio.

Another reason hollow filaments are desirable is that the ends of paint brush bristles are flagged (i.e., split) so that the tip of the paint brush will deposit paint more evenly and uniformly. Hollow bristles, in general, produce more uniformly flagged ends and less fraying of the flagged end portions.

Even though the paint brush industry has long demanded a hollow, tapered synthetic bristle (because it was postulated that such a bristle would maximize the desired properties), the filament manufacturing industry had been unable to provide such a structure for a number of reasons. In the first place, it has been difficult to produce level, hollow bristles, and when it is then necessary to taper the bristle, the difficulties become compounded. Early efforts have been mixed and inconsistent, suitable fibers sometimes being obtained and other times not being obtained; such inconsistency is unsuitable for commercial production.

Two very important defects have been noted in attempts to produce tapered, hollow bristles. These are the tendency of the filament to either flatten, as shown in FIG. 1A, or fail to form a circular cross-section, as shown in FIG. 1B, the resultant cross-section in the latter case being similar to the numeral 6 or its mirror image, as shown in FIG. 1B. Both of theses undesirable cross-sections have repeatedly occurred in spite of all efforts to obtain the circular cross-section desired. It must be remembered that the hollow bristles are very small and, therefore, procedures such as shown by the Sheridan U.S. Pat. No. 2,940,126, relating to the manufacture of tapered medical-surgical tubes, are not satisfactory as one cannot use Sheridan's circular die opening because of the small dimensions involved. In other words, while a mandrel may be used when making large tubes, such as shown in the Sheridan patent, one cannot use such a device in making bristles because the dimensions are so small, and because the dies involved must, for economical reasons, have up 800 or more orifices. Supporting 800 tiny mandrels within 800 circular orifices of small dimension, and maintaining the alignment, is not feasible.

It has, accordingly, been proposed in a number of patents (note, for example, van Drunen et al U.S. Pat. Nos. 3,323,168; Opfell 3,558,420; Shimoda et al 3,600,491) to provide split, or less than fully circular, orifices for the spinning of hollow filaments. Yet, it is these types or orifices which have produced inconsistent results leading to structures such as shown in FIGS. 1A and 1B, noting, for example, FIG. 8 of Shimoda et al and FIG. 6 of the Bishop et al U.S. Pat. No. 3,340,571. The FIG. 4 orifice of Shimoda consistently produces a collapsed structure (FIG. 1A). While many prior patents show idealized pictures of hollow filaments (e.g., Opfell U.S. Pat. No. 3,558,420, FIGS. 11 and 12; Tolliver, U.S. Pat. No. 3,772,137, FIGS. 2 and 4; Hodge, U.S. Pat. No. 3,924,988, FIGS. 3 and 5; Cox, U.S. Pat. No. 4,020,229), in fact it will be understood that following the directions of the prior art patents does not provide sufficient regularity and consistency, and two of the major problems which ensue are flattening of the filament, as shown in FIG. 1A, and failure to fuse which results in the numeral 6 configuration, as shown in FIG. 1B.

Two other major problems have occurred during prior attempts to taper the hollow bristles. The first of these is that stretching of a hollow bristle to provide a taper has a tendency to produce a bristle of inconsistent wall thickness. The second problem relates to the uniformity of the taper itself from bristle to bristle: tapered bristles are somewhat bottle-shaped, i.e. there is a neck-down location at some point along the length of the bristle where the slope of the taper is greater than at any other location. To produce a satisfactory paint brush with suitable snap-back and consistent properties, the location of the neck-down must be approximately the same in every bristle in the paint brush. In past attempts, it has not been possible to make a hollow, tapered brush bristle with either consistent wall thickness or consistency of neck-down location.

SUMMARY

It is, accordingly, an object of the instant invention to provide for improved paint brushes.

It is another object to provide an improved tapered hollow paint brush bristle, a method for its production and an orifice for extruding the same.

It is yet another object to overcome deficiencies in the prior art, such as those indicated above.

It is another object of the instant invention to provide a bristle spinnerette and method which enables the production of consistently good tapered hollow bristles.

It is a further object to provide tapered, hollow bristles having superior stiffness/weight ratio; another object to provide such tapered hollow bristles which are consistently uniform in their flagging properties, and which display flagged end portions which are less frayed.

It is yet another object to provide a spinnerette and method which enables the production of superior tapered hollow bristles without causing flattening or the unfused numeral 6 configuration.

It is another object of the invention to provide a tapered hollow brush bristle having a regularity of wall thickness from one end to the other, i.e., a relatively constant ratio of cross-sectional solid area to cross-sectional open area from one end to the other, preferably varying no more than 5%.

It is a further object to provide a tapered hollow brush bristle having a consistent neck-down location, and means for so obtaining such a consistent structure.

These and other objects and the nature and advantages of the instant invention will be more apparent from the disclosure below. For a better understanding of the invention, as well as the above and other objects and the nature and advantages of the instant invention, possible embodiments thereof will now be described with reference to the attached drawing, it being understood that these embodiments are intended as merely exemplary and in no way limitative.

IN THE DRAWING

DETAILED DESCRIPTION OF THE EMBODIMENTS

Figure 1A:
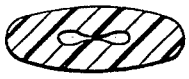
FIG. 1A. PRIOR ART
FIGS. 1A and 1B are cross-sections of prior art attempts to make hollow bristles.
Figure 1B:
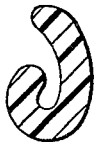
FIG. 1B. PRIOR ART
Figure 2:
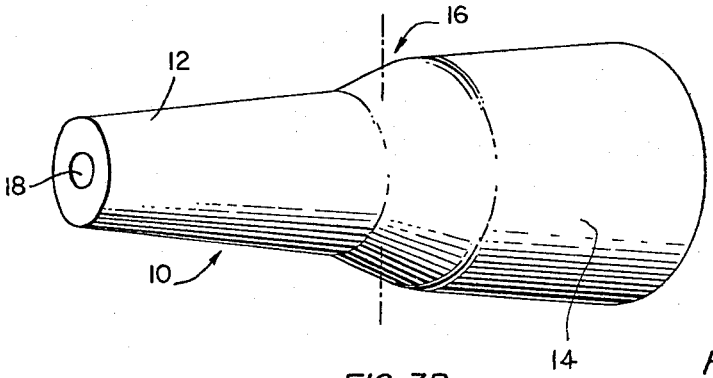
FIG. 2 is an exaggerated, schematic perspective view of a tapered bristle in accordance with the instant invention.

A tapered, hollow brush bristle 10, in accordance with the instant invention, has a tip portion 12 and a butt portion 14, it being seen in FIG. 2 that the bristle is continuously tapered from one end to the other. It is also quite clear from FIG. 2 that there is a central portion, referred to as the "neck-down" location 16, were the slope of the taper is greater than elsewhere along the length of the bristle, the overall effect being to give the bristle a generally "bottle"-shape, it being understood that the radial dimensions are greatly exaggerated in FIG. 2 compared with the axial dimensions. An axial hollow 18 passes through the center of the bristle 10 from one end to the other.

Figure 5:
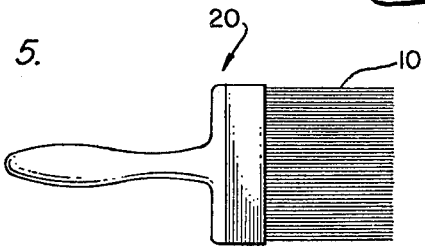
FIG. 5 is a plan view of the paint brush 20.

In the manufacture of satisfactory paint brushes, such as the paint brush 20 of FIG. 5, it is essential that the location of the neck-down 16 of each of the bristles 10 in the brush be at approximately the same location. This necessity has heretofore been a primary obstacle to the utilization of tapered, hollow synthetic bristles; if the location of the neck-down 16 varies from bristle to bristle, then the "snap-back" properties of the brush will be unsatisfactory. Bristles 10 of the present invention, of any given length from 1 inch to 6 inches, consistently have the neck-down location 16 at the same position, depending on the particular length of the bristle, at 1 inch to $1\frac{3}{4}$ inches from the butt end. For example, for a two-inch bristle, the neck-down location may be at the mid-point of the bristle, i.e., one inch from the butt end, and regardless of the exact dimension selected, all the bristles of such length will have the neck-down at about the same location. For a paint brush having bristles of $4\frac{3}{4}$ inches in length, it is desirable to locate the neck-down 16 at about $1\frac{3}{4}$ inches from the butt end.

Figure 3A:
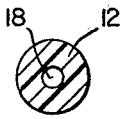
FIGS. 3A and 3B are cross-sections of a bristle of FIG. 2 taken, respectively, near the tip end butt ends thereof; and, FIG. 4 is a bottom plan view, greatly exaggerated in size, of a spinnerette opening used to make the bristles of FIG. 2.
Figure 3B:
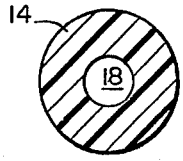

Another crucial requirement for a satisfactory paint brush 20, and a second deficiency in prior art attempts to make hollow tapered synthetic brush filaments for a paint brush having proper "snap-back" properties, is the very difficult to achieve requirement that the ratio of cross-sectional hollow area to cross-sectional wall area remain consistent from one end of the bristle to the other. FIG. 3A shows a cross-section of the bristle 10 along the length of the tip portion 12, and FIG. 3B shows a similar cross-section of the bristle 10 along the length of the butt portion 14. While it is clearly seen that the size of the central hollow 18 varies along the length as does the actual wall thickness of the bristle, it is quite important that the ratio of these values stays relatively constant from one end of the bristle to the other, namely within plus or minus 5% of the selected value.

Failure to maintain such consistency of cross-section provides a paint brush with inconsistent and unsatisfactory "snap-back". The bristle 10 of the instant invention comprises approximately 10–50% hollow area 18 and 90–50% wall thickness area at all cross-sections along the length of the bristles 10, preferably 30% hollow and 70% wall. If the central hollow exceeds 50% of the cross-sectional area, the bristles lack sufficient brush stiffness (snap-back). Bristles can, in accordance with the present invention, have an outer diameter at the butt end ranging from 3 to 30 mils, and an outer diameter at the tip end ranging from 1 to 20 mils.

Tapered, hollow paint brush bristles of the instant invention may be formed of a variety of polymers, including polyesters, nylons, polyolefins and blends of such polymers. Preferred materials are polybutyl terephthalate and nylon 6,12.

The shape of the spinnerette nozzle through which the bristles are extruded or spun, and its dimensions, are extremely important to the successful achievement of the hollow, tapered bristle 10. The die configuration 30 shown in FIG. 4 having an almost fully circular slot 32 and in which the central portion 34 is supported by a very narrow pin 36 has been the only successful die shape which has been found so far, which will give a satisfactory product. In such a die 30, and depending on the size of the hollow bristle desired, the outer diameter of the slot 32 may range from 15 to 100 mils, the thickness of the slot from 5.6 to 7 mils, and the width of the pin 36 from about 4.5 to 6 mils. Also important is the length of the slot opening 32 or the "land" which may be from 23 to 38 mils in length.

The rate of throughput of the polymer through the spinnerette is dependent on a variety of factors, including the polymer being extruded, the distance of the spinnerette face from the quench bath, the size of the spinnerette orifices 30 and the number of such orifices. Spinnerettes commonly have from 50 to 800 orifices. Depending upon the above factors, the throughput rate on a 1½ inch extruder will range between the values of 15 and 100 lbs./hr.

The equipment used for stretching and tapering the filaments leaving the extruder is the same equipment which is traditionally used in the manufacture of tapered, solid bristles. In accordance with the instant invention, the molten polymer is spun from the spinnerette into a water-quench bath at 70°–95° F. located a distance of ⅛ to 15/16 inch from the face of the spinnerette, and the hollow-spun continuous filaments are pulled in a variable manner from the spinnerette to provide the desired taper. This hot draw in which the taper is provided is on the average of 2:1, with a 1:1 draw at the butt end and a 3:1 draw at the tip end. Following this hot draw is an orientation stage during which the draw is 3:1 to 4:1.

The following example will further illustrate the manner in which the invention can be praticed, it being understood that the example is merely illustrative and not limitative.

Figure 4:
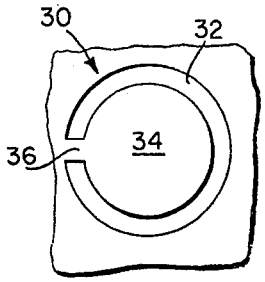

To make tapered, hollow bristles 10 have a butt end diameter of 12 mils and a tip end diameter of 8 mils, a spinnerette having 150 apertures as shown in FIG. 4 was provided, having the following dimensions:

slot 32 outer diameter: 42 mils
slot 32 width: 6 mils
land length: 33 mils
pin 36 width: 6 mils The spinnerette was placed on a 1½ inch extruder and black polybutyl terephthalate was extruded therethrough at the rate of 55 lbs./hr. A water-quench bath at 85° F. was provided 7/16 inch from the spinnerette face. The spun hollow filaments were drawn from the spinnerette face at an average draw rate of 2:1, such as to provide 0 draw at the butt end (1:1) and 3:1 draw at the tip end and a length for each draw sequence to provide, after orientation, a bristle length of 4¾ inches. The filaments were then passed to an orientation stage wherein they were further drawn 3.8:1, and then were cut to length.

The resultant bristles were highly uniform in the sense that all were essentially identical with the drawdown location 16 for the 4¾ inch bristles being 1¾ inches from the butt end. Each bristle also had a consistent ratio of cross-sectional area to hole 18 area along its length. The bristles were easily flagged at their tip ends 12 and made into superior paint brushes; flagging provided a greater than normal flag length which constituted an additional advantage.

The foregoing description of the specific embodiment will so fully reveal the general nature of the invention that others can, by applying current knowledge, readily modify and/or adapt such specific embodiment without departing from the generic concept and, therefore, such adaptations and modifications should and are intended to be comprehended within the meaning and range of equivalents of the disclosed embodiment. It is to be understood that the phraseology or terminology employed herein is for the purpose of description and not of limitation.

What is claimed is:

1. A spinnerette for the manufacture of hollow, tapered bristles, comprising a plurality of slot apertures, each said slot aperture forming an almost complete circle and having located therein a solid interior portion supported by a single pin which interrupts the slot orifice and prevents said slot orifice from forming a complete circle, each said pin having a width of approximately 4.5–6 mils, the width of each said slot being 5.6–7 mils, the outer diameter of each said orifice being 23–70 mils, and the land length of each said orifice being 23–38 mils.

2. A method of forming bristles comprising: extruding a synthetic resin through a spinnerette as a melt at a rate of 22–75 lbs./hr. and into an aqueous quench bath at 70°–95° F. spaced ⅛ to 15/16 of an inch from the face of said spinnerette; irregularly drawing the extrudate from the spinnerette at approximately an average draw rate of 2:1 such that for producing a hollow bristle of given length, the butt end will be drawn at approximately 1:1 and the tip end at approximately 3:1; and orienting the drawn and quenched filaments 3:1 to 4:1 before cutting to size; said spinnerette comprising a plurality of slot apertures, each said slot aperture forming an almost complete circle and each located therewithin a solid interior portion supported by a pin which interrupts the slot orifice and prevents said slot orifice from forming a complete circle, each said pin having a width of approximately 4.5–6 mils, the width of each said slot being 5.6–7 mils, the outer diameter of each said orifice being 23–70 mils, and the land length of each said orifice being 23–38 mils.

3. A method of forming bristle members comprising: extruding a synthetic resin through a multitude of spinnerette apertures as a melt at a rate of 22–75 lbs/hr. and into an aqueous quench bath at 70°–95° F. spaced ⅛ to 15/16 of an inch from the face of said spinnerette and forming hollow extrudate strands; irregularly drawing the extrudate strands from the spinnerette at approximately an average draw rate of 2:1 such that for producing a hollow bristle member of given length, the butt end will be drawn at approximately 1:1 and the tip end at approximately 3:1; and orienting the drawn and quenched hollow filaments 3:1 to 4:1 before cutting to size; said spinnerette comprising a plurality of slot apertures, each said slot aperture forming an almost complete circle and each located therewithin a solid interior portion supported by a pin which interrupts the slot orifice and prevents said slot orifice from forming a complete circle, each said pin having a width of approximately 4.5–6 mils, the width of each said slot being 5.6–7 mils, the outer diameter of each said orifice being 23–70 mils, and the land length of each said orifice being 23–38 mils.

4. The method according to claim 3 and the step of flagging the tip end of said bristle member.

5. The method according to claim 3 wherein said synthetic resin is nylon.

6. The method according to claim 3 wherein said synthetic resin is polyolefin.

7. The method according to claim 3 wherein said synthetic resin is polyester.

8. The method according to claim 3 wherein said synthetic resin is polybutyl terephthalate.

9. The method according to claim 3 wherein said synthetic resin is a blend which includes polybutyl terephthalate as a component.

* * * * *